US005339945A

United States Patent [19]

Brash et al.

[11] Patent Number: 5,339,945

[45] Date of Patent: Aug. 23, 1994

[54] INDEXING DEVICE FOR A GRAVITY LOG-FEEDING SYSTEM

[75] Inventors: Douglas J. Brash, Ramsey; Daniel S. Berkholz, Plymouth, both of Minn.; R. Ken Ericson; Anthony J. Ciaramitaro, both of Gloucester, Mass.

[73] Assignee: General Mills, Inc., Minneapolis, Minn.

[21] Appl. No.: 996,442

[22] Filed: Dec. 24, 1992

[51] Int. Cl.[5] ..... B26D 7/06

[52] U.S. Cl. ..... 198/468.8; 83/409.2; 83/417; 83/437

[58] Field of Search ..... 83/409, 409.1, 409.2, 83/417, 419, 437, 278; 221/227, 232, 279, 298, 299, 301; 414/790.8, 793.4; 198/468.8

[56] References Cited

U.S. PATENT DOCUMENTS

| | | | |
|---|---|---|---|
| 3,578,207 | 5/1971 | Danow | 221/232 |
| 3,651,968 | 3/1972 | Cleland | 221/298 X |
| 3,800,644 | 4/1974 | Garvis | 83/417 X |
| 4,299,150 | 11/1981 | Huston et al. | 83/409.2 X |
| 4,457,194 | 7/1984 | Mally | 83/417 X |
| 4,552,049 | 11/1985 | Matzinger et al. | 83/417 X |
| 4,644,729 | 2/1987 | Fessler | 83/417 X |
| 5,125,305 | 6/1992 | Morrison et al. | 83/409.2 X |

*Primary Examiner*—Eugenia Jones

*Attorney, Agent, or Firm*—L. MeRoy Lillehaugen; John A. O'Toole; Alan D. Kamrath

[57] ABSTRACT

A device (200) for indexing logs of frozen fish or the like is disclosed including log support fixtures (208) horizontally slideably mounted to slide blocks (206) in turn vertically slideable on guide rods (202). Horizontal legs (210) of the log support fixtures (208) are extended into slots (23) of tubes (22) of the severing apparatus (10) and separates the indexed logs from the prior logs in the tubes (22). When the prior logs have been completely severed, the log support fixtures (208) are moved from their extended positions to retracted positions by elongated channels (234) pushing against cam followers (220) carried by the log support fixtures (208). Then the slide blocks (206) are slid upward on the guide rods (202) from their lower positions by lifting a lifting bar (204) independently slideably mounted to the guide rods (202). The cam followers (220) abut against the front fingers (238) of the elongated channels (234) to prevent the log support fixtures (208) from sliding to their extended positions while the slide blocks (206) are being raised. When the slide blocks (206) are in their upper positions, the log support fixtures (208) are moved to their extended positions by the elongated channels (234) pushing against the cam followers (220). Then the lifting bar (204) is lowered on the guide rods (202) such that the horizontal legs (210) rest upon the upper end of and separate the indexed logs from the succeeding logs in the tubes (22).

21 Claims, 4 Drawing Sheets

INDEXING DEVICE FOR A GRAVITY LOG-FEEDING SYSTEM

BACKGROUND

The present invention generally relates to devices for indexing individual pieces in a magazine, particularly to indexing devices for gravity-fed magazines, and specifically for indexing devices for apparatus for severing frozen columns or logs of fish or the like.

In the apparatus of the type as shown and described in U.S. Pat. Nos. 4,299,150 and 5,125,305 or the like, logs of fish are severed from the bottom into portions. It should be noted that logs are stacked in the magazine with the second log in each tube resting on the first or bottom log in the tube. It should further be appreciated that the lengths of the logs of fish are not exact and often the last cut in the bottom log does not leave the last portion of the log equal to the desired thickness of portions. As the second log is resting directly on top of the first log, the next cut would be in the second log with the total thickness then being made up by the last section of the first log and the initial section of the second log. At least one of such sections and probably both would then not be commercially marketable as being less than a nominal thickness. Thus, a need exists for insuring that the first cut in a new fish log will be at the total thickness desired to trim waste by approximately 50% as only the last sections of the fish logs may not be of the nominal thickness.

SUMMARY

The present invention solves this need and other problems in the field of gravity log-feeding systems by providing, in the preferred form, a fixture including a leg of a size insertable through a slot in the magazine of the feeding system and into the magazine for placement between the logs in a stacked arrangement with the fixture being movable in a direction parallel to the feeding direction between a first position and a second position, with the leg inserted in the slot in front of the indexed log in the magazine for separating the indexed log from a prior log in the magazine in the first position and with the leg inserted in the slot in back of the indexed log in the magazine for separating the indexed log from a succeeding log in the magazine in the second position.

It is thus an object of the present invention to provide a novel device for indexing individual pieces in a magazine of a feeding system.

It is further an object of the present invention to provide such a novel indexing device for gravity-fed magazines.

It is further an object of the present invention to provide such a novel indexing device for magazines of apparatus for severing frozen fish logs or columns.

It is further an object of the present invention to provide such a novel indexing device insuring that the first cut in the log is at the desired portion thickness to reduce waste generation.

It is further an object of the present invention to provide such a novel indexing device which does not modify operation of the severing apparatus.

It is further an object of the present invention to provide such a novel indexing device allowing reliance of gravitational pressure in the feeding system.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
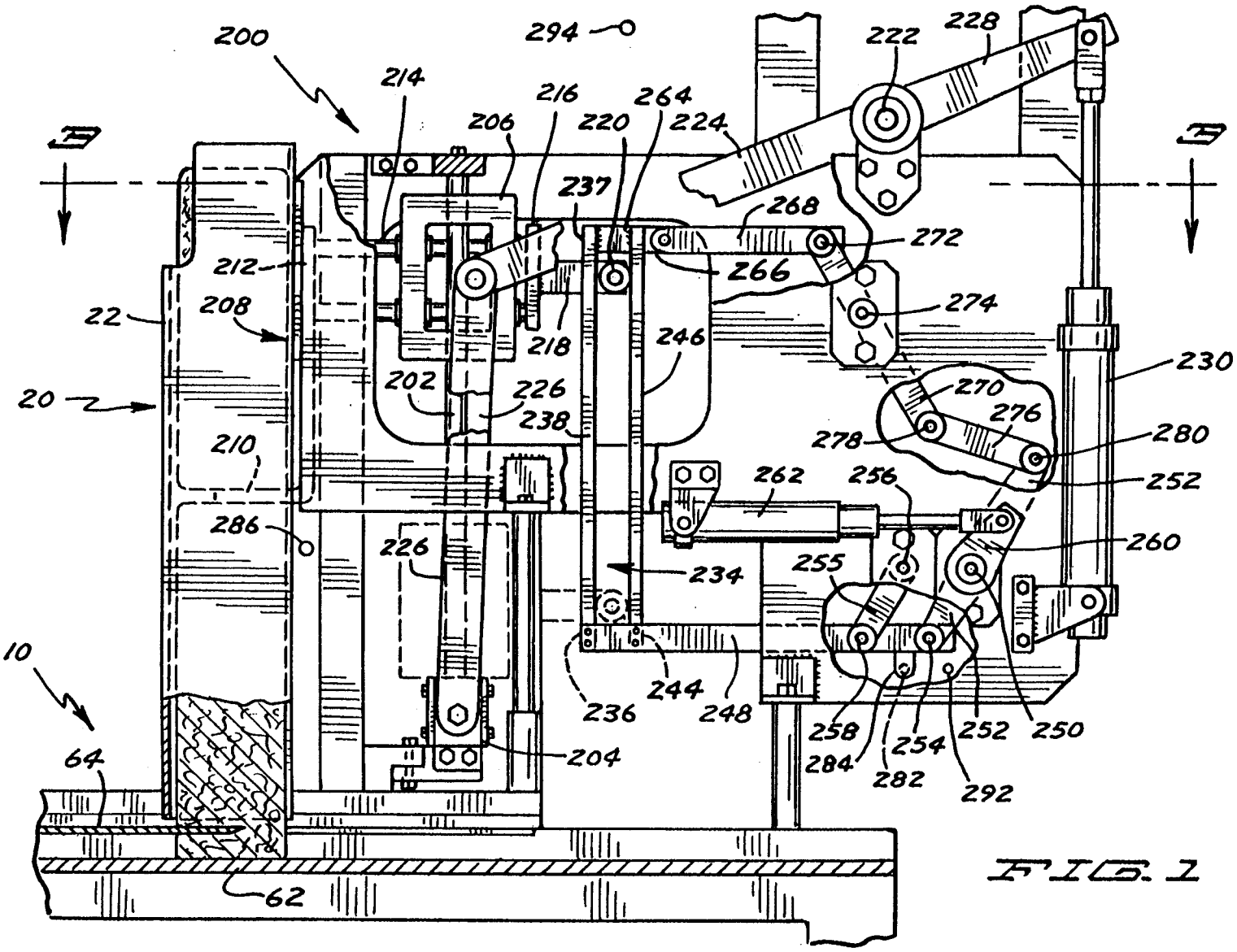
FIG. 1 shows a side elevational view of a device for indexing frozen columns or logs of fish according to the preferred teachings of the present invention, with portions broken away to show constructional details.
Figure 2:
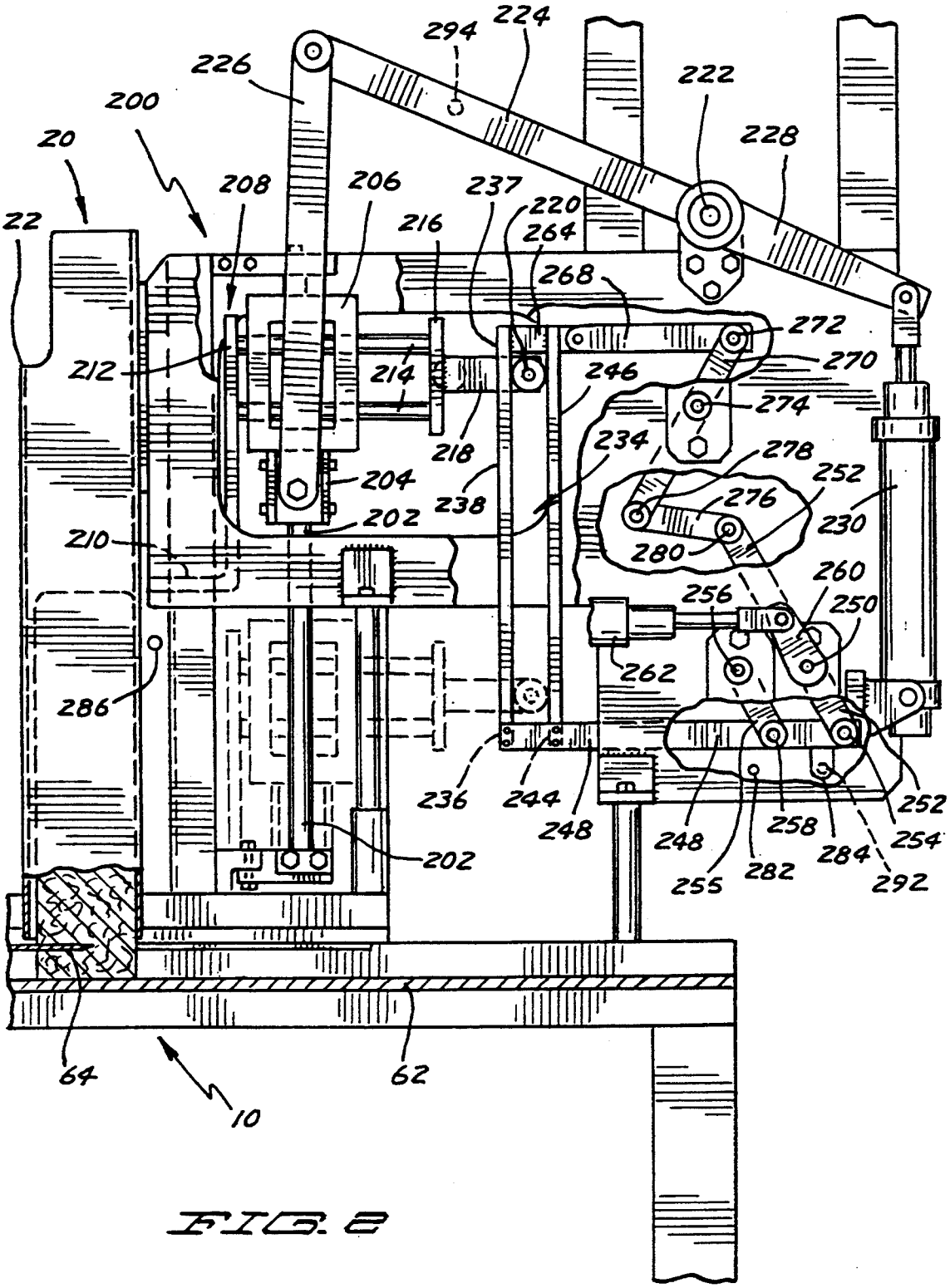
FIG. 2 shows a side-elevational view of the device of FIG. 1, with portions broken away to show constructional details.
Figure 3:
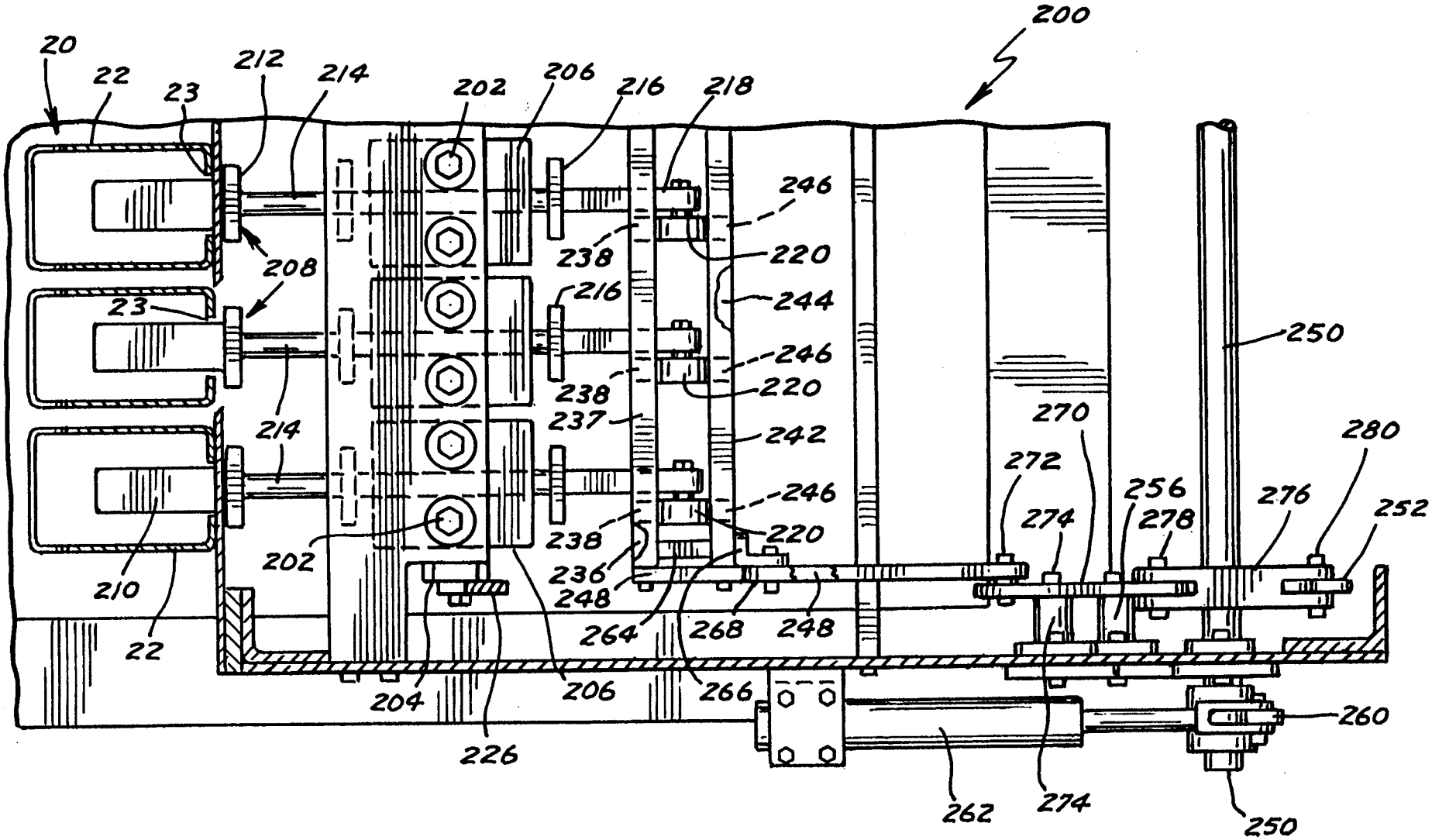
FIG. 3 shows a cross-sectional view of the device of FIG. 1 according to section line 3-3 of FIG. 1.
Figure 4:
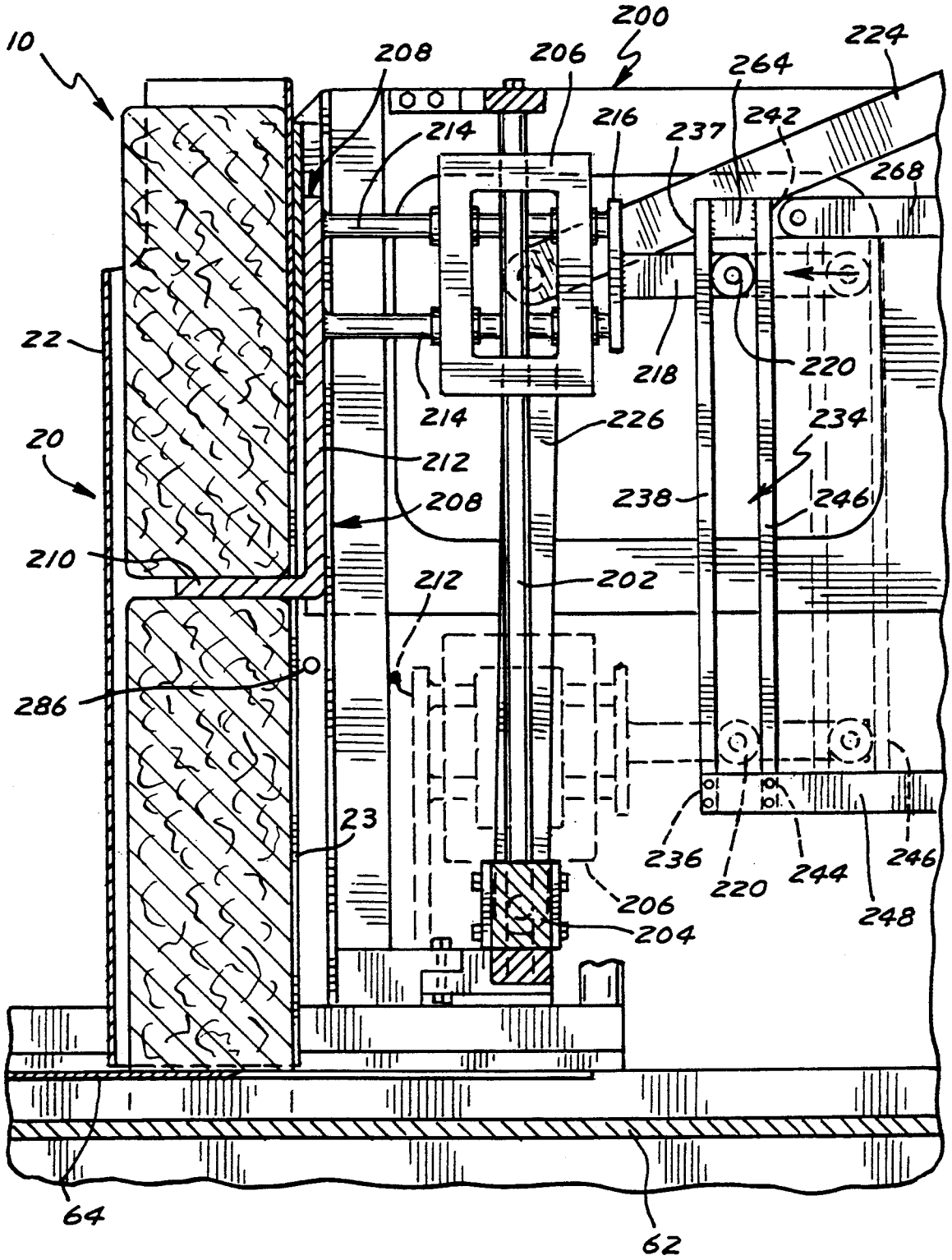
FIG. 4 shows a cross-sectional view of the device of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "above", "forward", "rearward", "front", "back", "outer", "inner", "upper", "lower", "height", "width", "end", "side", "horizontal", "vertical" and similar terms are used herein, it should be understood that these terms have reference only to the structure shown in the drawings as it would appear to a person viewing the drawings and are utilized only to facilitate describing the invention.

DESCRIPTION

Device for indexing or singulating frozen columns or logs of fish according to the preferred teachings of the present invention is shown in the drawings and generally designated 200. Device 200 is utilized with an apparatus 10 for severing the frozen columns of fish or the like into identical portions. Apparatus 10 may be of the type as shown and described in U.S. Pat. Nos. 4,299,150 and 5,125,305. Generally, apparatus 10 includes a magazine 20 composed of a number (such as eight) of vertical tubes 22 having a rectangular cross section corresponding to a cross section of one frozen column or log. Each tube 22 includes an elongated slot 23 extending in the feeding direction of the logs which in the most preferred form is vertically for the full height thereof. Tubes 22 slideably receive frozen columns or logs in a stacked arrangement for feeding in a feeding direction which is vertically downward in the preferred form and particularly for moving under gravitational forces in the most preferred form toward a blade 64 which cuts a portion from the bottom of each of the frozen columns or logs resting on anvil 62, with it being possible to vertically stack an additional frozen column or log in each of the tubes 22.

Generally, device 200 includes vertical movement guides 202 associated with each tube 22, with guides 202 being in the preferred form of first and second spaced, parallel, vertical rods extending in a direction parallel to the feeding direction. A lifting fixture 204 shown in the preferred form as an elongated horizontal bar having vertical bores therein for slideable receipt on rods 202 is vertically movable relative to rods 202. A slide block 206 is associated with each set of guide rods 202 and with each tube 22, with blocks 206 being slideably mounted on guide rods 202 independently of lifting fixture 204 and in the most preferred form by vertical bores therein for slideable receipt on rods 202.

A log support fixture 208 is associated with each tube 22 and with each slide block 206. Fixture 208 in the most preferred form is generally L-shaped including a horizontal leg 210 which is movable horizontally and vertically in slots 23 of tubes 22 and a vertical leg 212. Fixtures 208 are independently horizontally movable relative to and supported by slide blocks 206 by first and second, vertically spaced, horizontal slide shafts 214 attached to fixtures 208 and slideably mounted and received in horizontal bores extending through slide blocks 206. Specifically, each fixture 208 is independently movable in a direction perpendicular to the log feeding direction which is horizontal in the most preferred form between an extended position with leg 210 extending in tube 22 through slot 23 and a retracted position with fixture 208 located outside of and in a noninterferring relation with tube 22. Vertically extending pull bars 216 are secured to the free ends of shafts 214 on the opposite side of slide blocks 206 than fixtures 208. Horizontally extending cam arms 218 extend from pull bars 216, with a rotatable cam follower 220 mounted to the free end of each cam arm 218. Thus, cam followers 220 are carried by slide shafts 214 through bars 216 and arms 218.

Slide blocks 206 are slideable on guide rods 202 between a first, lower position and a second, upper position, with slide blocks 206 being slideable under gravitational forces from the upper position to the lower position in the most preferred form. In the upper position, legs 210 of fixtures 208 are vertically spaced above anvil 62 generally equal to and slightly more than the vertical height of a single frozen column or log slideably received in tubes 22. In the lower position, legs 210 of fixtures 208 are vertically spaced above anvil 62 generally equal to the vertical height of a portion which is cut from the frozen column or log by blade 64. Slide blocks 206 in the most preferred form are simultaneously raised on guide rods 202 by sliding lifting bar 204 upwardly on guide rods 202. Specifically, in the most preferred form, a horizontal pivot shaft 222 extends across the width of device 200 behind and above guide rods 202 and perpendicular to the feeding direction of the logs. On opposite sides of device 200, first lifing arms 224 extend radially from shaft 222. Second lifting arms 226 extend between and are pivotally mounted on the opposite ends of lifting bar 204 and the free ends of arms 224. Shaft 222 is rotated by any suitable means such as a crank arm 228 extending radially from one end of shaft 222. An air cylinder 230 extends between the frame of device 200 and the free end of crank arm 228. Thus, with the extension and contraction of cylinder 230, crank arm 228 rotates shaft 222 which in turn pivots arms 224 and 226 sliding bar 204 on guide rods 202. It can then be appreciated that since slide blocks 206 are located above lifting bar 204 on guide rods 202, slide blocks 206 are slid vertically upward to their upper position when bar 204 is raised by arms 224 and 226 on guide rods 202 and are allowed to slide vertically downward to their lower position when bar 204 is lowered by arms 224 and 226 on guide rods 202.

Fixtures 208 are moved from their retracted positions to their extended positions when slide blocks 206 reach their upper positions and are moved from their extended positions to their retracted positions when slide blocks 206 reach their lower positions. In the most preferred form, an elongated track or channel 234 is provided for vertical slideable receipt of each cam follower 220. Specifically, channels 234 include first vertically extending fingers 238 extending between first and second elongated bars 236 and 237 at locations corresponding to cam followers 220. Channels 234 further include second fingers 246 extending between third and fourth elongated bars 242 and 244 at locations corresponding to cam followers 220 and fingers 238. Fingers 238 and 246 are spaced from each other to vertically slideably receive cam followers 220. It should be noted that cam arms 218 extend between and do not abut with fingers 238 and 246. The opposite ends of bars 236 and 244 are secured in a spaced, parallel relation to first and second pusher arms 248 located on opposite sides of device 200. A horizontal pivot shaft 250 extends across the width of device 200 parallel to and spaced from shaft 222 and perpendicular to the feeding direction of the logs. First and second pivot arms 252 are secured on opposite ends of shaft 222 and extend diametrically therefrom. The free ends of arms 248 are pivotally secured to the lower free ends of arms 252 about a pivot axis 254. First and second linkage arms 255 are pivotally mounted to the frame of device 200 about an axis 256 and to arms 248 about an axis 258. The length between axes 256 and 258 is equal to the length between the rotation axis of shaft 250 and axis 254 and the length between axes 254 and 258 is equal to the length between the rotation axis of shaft 250 and axis 256 to form a parallelogram linkage. In the most preferred form, the rotation axis of shaft 250 and axis 256 are arranged in the same horizontal plane such that axes 254 and 258 and arms 248 extend generally horizontally in all positions of arms 248. Shaft 250 is rotated by any suitable means such as a crank arm 260 extending radially from shaft 250. An air cylinder 262 extends between the frame of device 200 and the free end of crank arm 260.

Bars 237 and 242 are held in spaced relation by spacers 264 sandwiched therebetween. The opposite ends of bar 242 include ears 266 which are pivotally secured to first and second pusher arms 268 located on opposite sides of device 200. The free ends of arms 268 are pivotally secured to the upper free ends of first pivot arms 270 about a pivot axis 272. Pivot arms 270 are pivotally mounted to the frame of device 200 about a pivot axis 274 located parallel to and spaced from shaft 250 and intermediate their ends. The lower ends of arms 270 are pivotally mounted to the upper ends of connector arms 276 about a pivot axis 278. The lower ends of connector arms 276 are pivotally mounted to the upper ends of pivot arm 252 about a pivot axis 280.

Thus, with the extension and contraction of cylinder 262, crank arm 260 rotates shaft 250-which in turn pivots arms 252, moving arms 248 in a direction perpendicular to shaft 250 and horizontally in the most preferred form due to the parallel linkage with linkage arms 255. Arms 252 also pivot arms 276 which in turn pivot arms 270 moving arms 268 in a direction generally perpendicular to shaft 250, with the pivotal interconnection of arms 268 to channel 234 in the most preferred form allowing channels 234 to remain vertical and move slightly vertically with the pivoting of arms 252 and 255 about axes 250 and 256. It should then be noted that in the most preferred form of the present invention, arms 248 and 268 are simultaneously moved in generally the same direction with rotation of shaft 250 by a single cylinder 262.

Now that the basic construction of device 200 according to the preferred teachings of the present invention has been set forth, the operation and subtle features of device 200 can be explained and appreciated. For the sake of explanation, it will be assumed that first logs have been slid in each tube 22 with the bottom ends thereof resting on anvil 62, slide blocks 206 are in their upper positions, and fixtures 208 are located in their retracted positions. Cylinder 262 is extended thereby rotating shaft 250. Rotation of shaft 250 causes pivoting of arms 252, 270 and 276 to simultaneously horizontally move arms 248 and 268 forward. With forward movement of arms 268, fingers 246 of channel 234 engage and push cam followers 220 forward to move fixtures 208 forward from their retracted positions to their extended positions, with legs 210 extending through slots 23 into tubes 22 at a height generally equal to and preferably above the top of the fish logs in each of the tubes 22. When fixtures 208 are in their extended positions, cylinder 230 is extended to rotate shaft 222. Rotation of shaft 222 causes pivoting of arms 224 and 226 causing lifting bar 204 to slide downwardly on guide rods 202 to its lower position. In the most preferred form, cylinder 230 is actuated by sensors which are positioned to sense when fixtures 208 are in their extended positions such as in the most preferred form by a proximity switch 282 which senses a position flag 284 secured to one of arms 248.

As slide blocks 206 are held in vertical position by lifting bar 204, slide blocks 206 will also slide downwardly on guide rods 202 under gravitational forces until the lower surfaces of horizontal legs 210 rest upon the top of the fish logs in tubes 22. At that time, the fish logs will hold slide blocks 206 in vertical positions on guide rods 202 above anvils 62 and independently of lifting bar 204. Second, indexed fish logs can then be slid in each of the tubes 22, with the bottom surfaces of the second fish logs resting upon the upper surfaces of horizontal legs 210. Thus, horizontal legs 210 separate the second, indexed logs from the first, prior logs. It can then be appreciated that the second fish logs place gravitational pressure upon the first, prior fish logs in each of the tubes 22. It should then be appreciated that as slide blocks 206 are lowered by the lowering of lifting bar 204, cam followers 220 will lower in channel 234 with fingers 246 preventing fixtures 208 from moving from their extended positions to their retracted positions as slide blocks 206 move from their upper positions to their lower positions.

Blade 64 is then reciprocated relative to anvil 62 to sever portions from each of the fish logs in tubes 22, with the first, prior fish logs becoming shorter and Slide blocks 206 moving downward on guide rods 202 after each severance and removal of such portions. This continues until the lower surfaces of horizontal legs 210 of all fixtures 208 are at a height above anvil 62 generally equal to the desired thickness of the severed fish portions. At that point, slide blocks 206 are in their lower positions and further downward movement of slide blocks 206 on guide rods 202 is stopped by lifting bar 204 which abuts with and holds slide blocks 206. As fixtures 208 are mounted to slide blocks 206, further downward movement of the second, indexed fish logs is stopped by horizontal legs 210. This condition can be electrically sensed such as by a photo cell switch 286 which senses when all support fixtures 208 are in their lower position by looking over the top of vertical legs 212.

With switch 286 sensing all fixtures 208 in their lower positions and during the severing cycle for apparatus 10 to remove the last section of the first fish logs (which have a thickness equal to or less than the desired thickness of the severed fish portions) from anvil 62 and specifically while blade 64 extends across the bottom of tubes 22 as can be automatically sensed such as by the use of a proximity switch, not shown, which senses the position of the blade moving structure, cylinder 262 is retracted to rotate shaft 250. Rotation of shaft 250 causes pivoting of arms 252, 270 and 276 to simultaneously horizontally move arms 248 and 268 rearward. With rearward movement of arms 248, fingers 238 of channels 234 engage and push cam followers 220 rearward to move fixtures 208 rearward from their extended positions to their retracted positions. With movement of fixtures 208 from their extended positions to their retracted positions, horizontal legs 210 are withdrawn from beneath the second fish logs in tubes 22 and from slots 23 of tubes 22, with the second fish logs then resting upon and being supported by blade 64. With the completion of the severing cycle for apparatus 10, blade 64 will withdraw from beneath the fish logs and tubes 22 allowing the fish logs to move under gravitational forces and rest upon and be supported by anvil 62.

When fixtures 208 are in their retracted positions, cylinder 230 is retracted to rotate shaft 222. Rotation of shaft 222 causes pivoting of arms 224 and 226 causing lifting bar 204 to slide upwardly on guide rods 202 to its upper position. In the most preferred form, cylinder 230 is actuated by sensors which are positioned to sense when fixtures 208 are in their retracted positions such as in the most preferred form by a proximity switch 292 which senses position flag 284 secured to one of arms 248.

As slide blocks 206 are held in vertical position by lifting bar 204, slide blocks 206 will also slide upwardly on guide rods 202. It should be noted that as slide blocks 206 move vertically upward, fixtures 208 are held in their retracted positions by cam followers 220 located within channels 234 and specifically are prevented from moving to their extended positions by fingers 238 of channels 234 as slide blocks 206 move from their lower positions to their upper positions. When slide blocks 206 reach their upper positions, cylinder 262 is again extended to move fixtures 208 forward from their retracted positions to their extended positions. In the most preferred form, cylinder 262 is actuated by sensors which are positioned to sense when slide blocks 206 are in their upper positions such as in the most preferred form by a proximity switch 294 which senses when one of arms 224 is in its upper position. In their extended positions, horizontal legs 210 extend through slots 23 into tubes 22 at a height generally equal to and preferably above the top of the second fish logs in each of the tubes 22 which now are supported on anvil 62. Thereafter the method is repeated to separate the second, indexed logs from the succeeding logs slideably received in tubes 22 to continuously feed fish logs to blade 64 of apparatus 10.

It can then be appreciated that since the second fish logs are held by fixtures 208 in tubes 22 above anvil 62 until the last section of the first fish logs has been removed, the first cut in the second fish log will be at the total thickness desired to thereby substantially reduce the number of portions which are not commercially marketable which are produced and thereby substantially reducing the amount of waste product generated. Additionally, since fixtures 208 are free to move vertically under gravitational forces, in the most preferred form, operation of apparatus 10 is not in any way modified and specifically reliance on gravitational pressure by the weight of fish logs above anvil 62 can be utilized.

It can then be further appreciated that the use of sensors, such as switches 282, 286, 292, and 294 in the most preferred form, allows automatic timing control and high-speed operation of device 200 in conjunction with that of apparatus 10 according to the preferred teachings of the present invention.

Although shown and described for use with a gravityfed magazine for an apparatus for severing logs of fish into portions, device 200 according to the teachings of the present invention can be utilized in other types of magazines and with other types of apparatus where individual logs or pieces are indexed from prior logs and from succeeding logs.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for indexing an indexed log in a magazine of a feeding system from a prior log and a succeeding log, with the magazine slideably receiving the logs stacked in a feeding direction and including an elongated slot extending in the feeding direction, comprising, in combination: a fixture; means for moving the fixture in a direction parallel to the feeding direction between a first position and a second position; and means for abutting with a back of the prior log and in front of the indexed log in the magazine for abutting with and separating the indexed log from the prior log in the magazine in the first position and for abutting with a back of the indexed log and in front of the succeeding log in the magazine for separating the indexed log from the succeeding log in the magazine in the second position comprising a leg of a size insertable through the slot and into the magazine for placement between the logs in the stacked arrangement, with the fixture including the leg.

2. The indexing device of claim 1 wherein the feeding direction is vertically downward.

3. The indexing device of claim 2 wherein the logs slide in the magazine under gravitational forces from the second position to the first position.

4. The indexing device of claim 3 wherein the moving means comprises means for moving the fixture between an extended position and a retracted position with the leg being movable in a direction perpendicular to the feeding direction between the extended position and the retracted position.

5. The indexing device of claim 4 wherein the moving means comprises, in combination: a slide block; and means for slideably mounting the fixture to the slide block between the retracted position and the extended position.

6. The indexing device of claim 5 wherein the moving means further comprises, in combination: means for slideably mounting the slide block in a direction parallel to the feeding direction between the first position and the second position.

7. The indexing device of claim 6 wherein the slide block slideably mounting means comprises guide rods

8. The indexing device of claim 5 wherein the moving means moves the fixture from the retracted position to the extended position at the second position and moves the fixture from the extended position to the retracted position at the first position.

9. The indexing device of claim 8 wherein the fixture slideably mounting means comprises slide shafts attached to the fixture, with the slide shafts being slideably mounted in the slide block; and wherein the moving means comprises, in combination: a cam follower carried by the slide shafts; and means for pushing the cam follower for moving the fixture between the retracted position and the extended position.

10. The indexing device of claim 9 further comprising, in combination: means for holding the fixture in the extended position when moving from the second position to the first position and for holding the fixture in the retracted position when moving from the first position to the second position.

11. The indexing device of claim 9 wherein the pushing means comprises, in combination: a first pusher arm for pushing the cam follower when the fixture is in the first position to move the fixture from the extended position to the retracted position; a second pusher arm for pushing the cam follower when the fixture is in the second position to move the fixture from the retracted position to the extended position; and means for moving the pusher arms.

12. The indexing device of claim 11 wherein the pushing means further comprises, in combination: first, second, third and fourth elongated bars, with the first and third elongated bars secured to the first pusher arm and the second and fourth elongated bars secured to the second pusher arm; a first finger extending between the first and second elongated bars at locations corresponding to the cam follower; and a second finger extending between the third and fourth elongated bars at locations corresponding to the cam follower and spaced from the first finger to slideably receive the cam follower therebetween.

13. The indexing device of claim 11 wherein the pusher arms moving means comprises, in combination: a shaft extending perpendicular to the feeding direction; means for rotating the shaft; a first pivot arm having first and second ends and mounted to the shaft intermediate the first and second ends of the first pivot arm, with the first pusher arm being pivotally connected to the first end of the first pivot arm; a second pivot arm having first and second ends, with the second pivot arm being pivotable intermediate the first and second ends of the second pivot arm about an axis parallel to and spaced from the shaft, with the second pusher arm being pivotally connected to the first end of the second pivot arm; and a connector arm having a first end pivotally connected to the second end of the first pivot arm and having a second end pivotally connected to the second end of the second pivot arm.

14. The indexing device of claim 3 wherein the moving means comprises, in combination: a slide block; and means for slideably mounting the slide block in a direction parallel to the feeding direction between the first position and the second position.

15. The indexing device of claim 14 wherein the slide block slideably mounting means comprises guide rods extending parallel to the feeding direction, with the slide block being slideably mounted to the guide rods.

16. The indexing device of claim 15 wherein the moving means further comprises, in combination: a lifting bar slideably mounted on the guide rods independent of the slide block; and means for sliding the lifting bar on the guide rods for moving the slide block from the first position to the second position and for lowering the lifting bar on the guide rods, with the slide block moving from the second position to the first position as the indexed log is fed in the magazine and independently of the lifting bar.

17. The indexing device of claim 16 wherein the sliding and lowering means comprises, in combination: a shaft extending perpendicular to the feeding direction; means for rotating the shaft; a first lifting arm mounted to the shaft and having a free end; a second lifting arm having a first end pivotally connected to the lifting bar and a second end pivotally connected to the free end of the first lifting arm.

18. The indexing device of claim 1 wherein the moving means moves the fixture between an extended position and a retracted position with the leg being movable in a direction perpendicular to the feeding direction between the extended position and the retracted position.

19. Device for indexing an indexed log in a magazine of a feeding system from a prior log and a succeeding log, with the magazine slideably receiving the logs in a stacked arrangement for feeding in a direction and including an elongated slot extending in the feeding direction, comprising, in combination: a fixture including a leg of a size insertable through the slot and into the magazine for placement between the logs in the stacked arrangement; means for moving the fixture in a direction parallel to the feeding direction between a first position and a second position, with the leg inserted in the slot in front of the indexed log in the magazine for separating the indexed log from the prior log in the magazine in the first position and with the leg inserted in the slot in back of the indexed log in the magazine for separating the indexed log from the succeeding log in the magazine in the second position, with the moving means moving the fixture between an extended position and a retracted position with the leg being movable in a direction perpendicular to the feeding direction between the extended position and the retracted position; means for sensing when the fixture is in the extended position; means for sensing when the fixture is in the extended position; means for sensing when the fixture is in the retracted position; means for sensing when the fixture is in the first position; and means for sensing when the fixture is in the second position.

20. Device for indexing an indexed log in a magazine of a feeding system from a prior log and a succeeding log, with the magazine slideably receiving the logs in a stacked arrangement for feeding in a direction and including an elongated slot extending in the feeding direction, comprising, in combination: a fixture including a leg of a size insertable through the slot and into the magazine for placement between the logs in the stacked arrangement; and means for moving the fixture in a direction parallel to the feeding direction between a first position and a second position, with the leg inserted in the slot in front of the indexed log in the magazine for separating the indexed log from the prior log in the magazine in the first position and with the leg inserted in the slot in back of the indexed log in the magazine for separating the indexed log from the succeeding log in the magazine in the second position; wherein the moving means comprises, in combination: a slide block; and means for slideably mounting the slide block in a direction parallel to the feeding direction between the first position and the second position.

21. The indexing device of claim 20 wherein the moving means further comprises, in combination: a lifting bar slideably mounted on the slide block slideably mounting means independent of the slide block; and means for sliding the lifting bar on the slide block slideably mounting means for moving the slide block from the first position to the second position and for lowering the lifting bar on the slide block slideably mounting means, with the slide block moving from the second position to the first position as the indexed log is fed in the magazine and independently of the lifting bar.

* * * * *